US007411182B2

(12) United States Patent
Fedorov et al.

(10) Patent No.: US 7,411,182 B2
(45) Date of Patent: Aug. 12, 2008

(54) REVERSE-TAYLOR CONE IONIZATION SYSTEMS AND METHODS OF USE THEREOF

(75) Inventors: Andrei G. Fedorov, Atlanta, GA (US); F. Levent Degertekin, Decatur, GA (US)

(73) Assignee: Georgia Tech Research Corp, Atlanta, GA (US)

( * ) Notice: Subject to any disclaimer, the term of this patent is extended or adjusted under 35 U.S.C. 154(b) by 223 days.

(21) Appl. No.: 11/336,136

(22) Filed: Jan. 19, 2006

(65) Prior Publication Data

US 2007/0164210 A1 Jul. 19, 2007

(51) Int. Cl.
*H05H 3/02* (2006.01)

(52) U.S. Cl. ..... 250/251; 250/288; 250/423

(58) Field of Classification Search ..... 250/251
See application file for complete search history.

(56) References Cited

U.S. PATENT DOCUMENTS 7,232,992 B2 * 6/2007 Whitehouse et al. ..... 250/288
2003/0129737 A1 * 7/2003 van der Weide ..... 435/285.2

* cited by examiner

*Primary Examiner*—David A. Vanore
*Assistant Examiner*—Phillip A. Johnston
(74) *Attorney, Agent, or Firm*—Thomas, Kayden, Horstemeyer & Risley

(57) ABSTRACT

Ionization systems, methods of using ionization systems, ion source systems, methods of using ion source systems, and methods of ionization, are described herein.

9 Claims, 5 Drawing Sheets

REVERSE-TAYLOR CONE IONIZATION SYSTEMS AND METHODS OF USE THEREOF

CROSS-REFERENCE TO RELATED APPLICATION

This application is related to copending U.S. Utility Application entitled "SCANNING ION PROBE SYSTEMS AND METHODS OF USE THEREOF" to Fedorov et al., filed on Jan. 19, 2006, having Ser. No. 11/336,137 , which is entirely incorporated herein by reference.

FIELD OF THE DISCLOSURE

The present disclosure relates generally to ionization systems and methods.

BACKGROUND

Mass Spectrometry (MS) is a 100-year old technology that relies on the ionization and fragmentation of molecules, the dispersion of the fragment ions by their masses, and the proper detection of the ion fragments on the appropriate detectors. There are many ways to achieve each of these three key MS processes, and this gives rise to different types of MS instrumentation systems having distinct characteristics.

Four major types of ionization techniques are commonly used to both break apart a larger molecule into many smaller molecules and at the same time ionize them so that they can be properly charged before mass dispersion. These ionization schemes include Electrospray Ionization (ESI), Electron Impact Ionization (EI) through the impact of high-energy electrons, Chemical Ionization (CI) through the use of other reactive compounds, and Matrix-Assisted Laser Desorption and Ionization (MALDI). Both ESI and MALDI also serve as means for sample introduction.

In particular, the electrospray ionization technique is a technique for spraying a sample molecule (which is brought into an ionic state by acid, or the like, in the solution) by applying a high voltage; forming liquid droplets (mist) on the order of microns, in which many solvent molecules are combined with protonated or ionized molecules; and spraying a liquid to dry and remove the solvent, followed by introducing the ions to an appropriate mass analyzer.

Each ion will have a corresponding mass-to-charge (m/z) ratio, which will become the basis to mass dispersion. Based on the physical principles used, there are many different ways to achieve mass dispersion, resulting in mass spectral data. A few of the commonly seen configurations include magnetic sectors, quadrapoles, Time-Of-Flight (TOF), and Fourier Transform Ion-Cyclotron Resonance (FT ICR).

However, there is a need in the art for novel ionization sources.

SUMMARY

Briefly described, embodiments of this disclosure, among others, include ionization systems, methods of using ionization systems, ion source systems, methods of using ion source systems, and methods of ionization.

One exemplary ion source system, among others, includes: an ion generation chamber including a conductive membrane disposed at a first end of the ion generation chamber and chamber walls interfaced with the conductive membrane. The conductive membrane includes a plurality of orifices through the conductive membrane. The orifices have a diameter of about 1 nanometer to 10 millimeters. A voltage source is in electrical communication with the conductive membrane.

One exemplary method, among others, includes: providing an ion source system as described herein; disposing the membrane into a sample; applying a first voltage to the membrane; ionizing molecules in the sample adjacent the membrane to produce a plurality of first ionized molecules; and producing a reverse-Taylor-cone of the sample through one or more of the orifices in the membrane. The reverse-Taylor-cone extends into the ion generation chamber. The reverse-Taylor-cone of the sample includes the first ionized molecules.

Another exemplary method, among others, includes: disposing an ion generation chamber into a sample, wherein the ion generation chamber includes a conductive membrane having a plurality of orifices; applying a first voltage to the conductive membrane; ionizing molecules in the sample adjacent the conductive membrane to produce a plurality of solvated first ionized molecules; producing a reverse-Taylor-cone of the sample through one or more of the orifices in the conductive membrane, wherein the reverse-Taylor-cone extends into the ion generation chamber, and wherein the reverse-Taylor-cone of the sample includes the solvated first ionized molecules; dispersing solvated first ionized molecules from the reverse-Taylor-cone into the ion generation chamber; generating an electromotive force within the ion generation chamber that drives the solvated first ionized molecules away from the membrane; and generating de-solvated first ionized molecules from the solvated first ionized molecules.

One exemplary ionization system, among others, includes an array of ion source systems as described herein.

Other systems, methods, features, and advantages of this disclosure will be or become apparent to one with skill in the art upon examination of the following drawings and detailed description. It is intended that all such additional systems, methods, features, and advantages be included within this description, be within the scope of this disclosure, and be protected by the accompanying claims.

BRIEF DESCRIPTION OF THE DRAWINGS

Further aspects of the present disclosure will be more readily appreciated upon review of the detailed description of its various embodiments, described below, when taken in conjunction with the accompanying drawings.

DETAILED DESCRIPTION

Ionization systems, methods of use thereof, ion source systems, methods of use thereof, electrospray mass spectrometry systems, and methods of use thereof, are disclosed. The present disclosure includes systems and methods for generation, collection, and/or detection of ions by producing an electrohydrodynamically-induced reverse-Taylor-cone. The reverse-Taylor cone is similar to the conventional Taylor cone used in electrospray ionization, except rather than spraying a solution out of a capillary tube filled with the solution to form a cone and disperse fluid into droplets, the cone described herein starts outside of the capillary (either at the free surface of the liquid or at each membrane orifice) and then is drawn into the sampling capillary by the electric force exerted on the ions upon application of appropriate electric field.

In general, embodiments of the present disclosure include an ion generation chamber that includes a membrane in contact with a sample solution. The membrane includes a plurality of orifices through the membrane. A voltage potential can be applied to the membrane to generate a reverse-Taylor-cone through the orifices in the membrane to disperse the sample solution as charged droplets (e.g., containing the ions from the sample) into the ion generation chamber. Although not intending to be bound by theory, these droplets proceed through a sequence of de-solvation (e.g., solvent evaporation) and electrical fission events leading to production of de-solvated "dry" ions. The ions can then be stored and/or analyzed using one or more techniques (e.g., mass spectrometry and sensors).

Embodiments of the present disclosure have applications in chemical and materials sciences as well as in cellular biology and medical research. In an embodiment of the present disclosure, chemical and/or biological species in a solution can be analyzed. In an embodiment, the electrospray system employs a mass spectrometry system to detect and identify the chemical and/or biological species. In another example, embodiments of the present disclosure can be used to study biological molecules on a single cell basis and/or study the biological molecules on the surface of the cell and/or within the cell. In another example, embodiments of the present disclosure can also be used for detection (e.g., high throughput imaging in an array format) of biochemical molecules that are intrinsically charged or that can be externally (e.g., electrochemically) charged (e.g., proteins, DNA, RNA, and the like) in analyzing biological tissue constructs, DNA/RNA/protein gel microarray readout, screening of the catalyst libraries, and the like.

Figure 1:
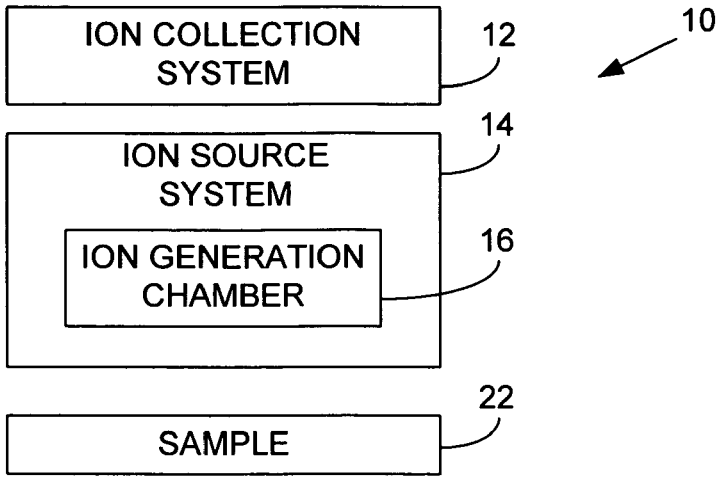
FIG. 1 illustrates a block diagram of an embodiment of an ionization system of the present disclosure.

FIG. 1 illustrates a block diagram of an embodiment of an ionization system 10. The ionization system 10 includes, but is not limited to, an ion collection system 12, an ion source system 14, and a sample 22. The ion source system 14 includes, but is not limited to, an ion generation chamber 16. The ionization system 10 can position the ion source system 14 at a location in the sample 22 in the x-, y-, and/or z-axis directions. In an embodiment, a portion of the ion source system 14 is in contact with the sample 22 (e.g., sample solution) or is disposed within the sample 22. In an embodiment, the ionization system 10 is an electrospray ionization system. In another embodiment, the ionization system 10 is an electrospray ionization system, and the ion collection system 12 is a mass spectrometry system.

In another embodiment, the ionization system 10 can include a plurality of independent ion source systems (e.g, an array of ion source system and/or an array of independent membrane) that can be used for high throughput applications. Each ion source system can be operated independently (e.g., in sensing and/or actuation) from the other ion source systems and/or operated in unison. Use of an array of independent ion source systems can facilitate analysis of a large area of a sample, and/or facilitate analysis of a plurality of samples.

The sample 22 can include, but is not limited to, a biological sample (e.g., cells, tissue constructs, DNA/protein microarrays, and the like), a chemical sample (e.g., catalysts, ionic liquids, and the like), and combinations thereof, disposed in a solution (e.g., a nonelectrolyte solution and/or an electrolyte solution). The sample can include an electrolyte such as, but not limited to, an electrolytic solution and/or electrolytic solid/gel. For example the electrolyte can include, but is not limited to, water, salts, organic solvents (e.g., methanol, toluene, and amines), gel conducting polymer, and combinations thereof.

The ion generation chamber 16 can include, but is not limited to, a conductive membrane located at one end of the ion generation chamber 16, chamber walls with integrated electrode or an array of individually-controlled electrodes, and optionally, a heating element adjacent the chamber walls to heat the area within the ion generation chamber 16 to assist in de-solvation of solvated ions that enter through the membrane. In general, the membrane of the ion generation chamber 16 is in contact with the sample. A voltage potential can be applied to the membrane or portions thereof to form ions from molecules present in the sample (e.g., via a redox reaction). As discussed in greater detail below, portions of the sample including the ions can be extracted from the sample solution, through the membrane, and into the ion generation chamber 16. The ion generation chamber 16 can be used to de-solvate the solvated ions that enter the ion generation chamber 16 and guide them through the ion generation chamber away from the membrane to an appropriate location in the ion generation chamber 16 or out of the ion generation chamber 16.

The shape of the ion generation chamber can vary depending on the specific application. In general, the ion generation chamber has a cylindrical, square, or rectangular geometry. The ion generation chamber has a length of about 10 nanometer to 100 centimeters and a width of about 1 nm to 100 mm. The ion generation chamber can be made of materials such as, but not limited to, conductors, semiconductors, and dielectrics.

The membrane is appropriately interfaced (e.g., electrically isolated) with the chamber walls of the ion generation chamber 16 so that different electric potentials can be applied to the membrane and/or electrodes on the chamber walls to produce an appropriate electric field driving ions via an electromotive force.

Figure 2:
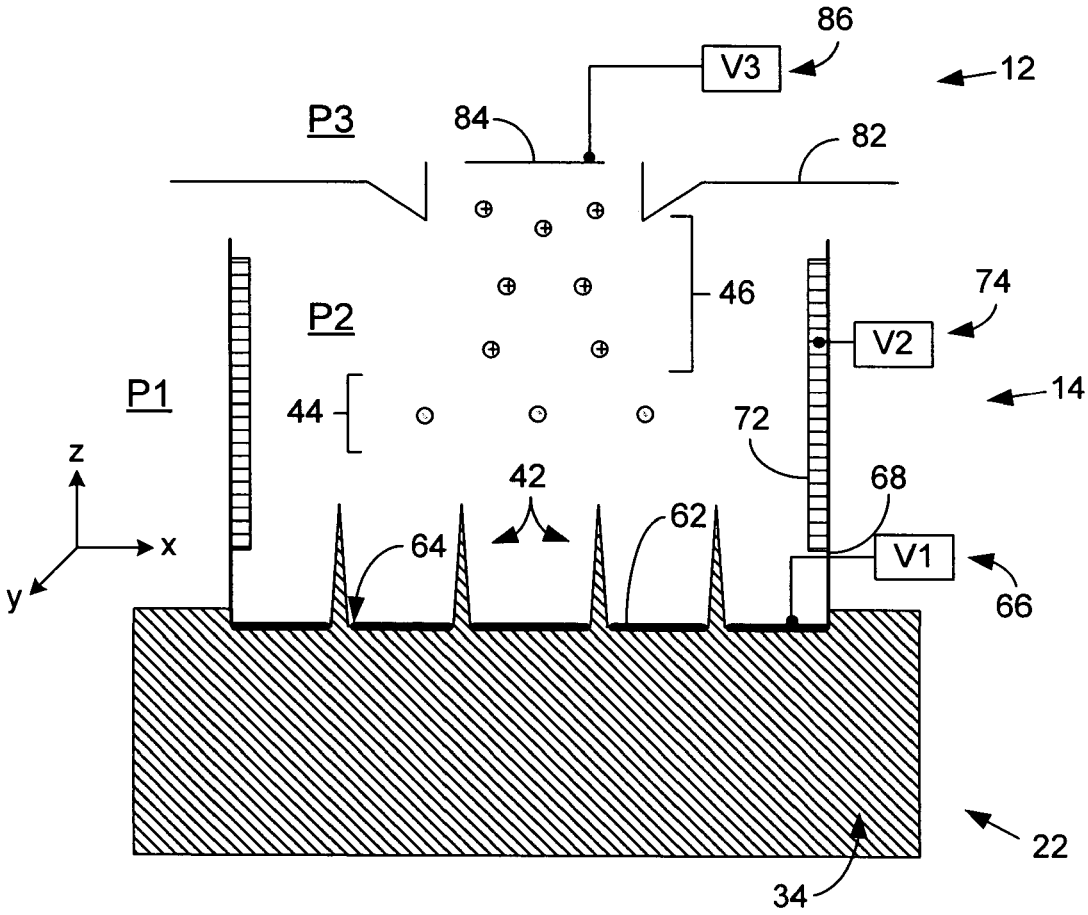
FIG. 2 illustrates an embodiment of another ionization system of the present disclosure.

The membrane includes a plurality of orifices through the membrane. Upon application of an appropriate electric potential (voltage) to the membrane, an electrohydrodynamically-induced reverse-Taylor cone of the sample solution is formed and extends through one or more of the plurality of the membrane orifices into the ion generation chamber 16 to form solvated ions. As mentioned above, the reverse-Taylor cone is similar to the conventional Taylor cone used in electrospray, except rather than spraying a solution out of a capillary tube filled with the solution to form a cone and disperse fluid into droplets, the cone described herein (42 as shown in FIG. 2) starts outside of the capillary (either at the free surface of the liquid or at each membrane orifice) and then is drawn into the sampling capillary (ion generation chamber) by the electromotive force exerted on the ions upon application of appropriate electric field created due to different voltages applied to the membrane electrode V1 and the chamber wall electrodes V2 (See FIG. 2). The formation of the reverse-Taylor cone is dependent, at least in part upon, the sample solution, the conductive membrane material, the diameters of the orifices, one or more of the applied electric potentials (electrode voltages), the electrode locations, the strength and orientation of the electric field, and the like.

The conductive membrane can be made of materials, such as, but not limited to, metals (e.g., gold, platinum, copper, steel, combinations thereof, and the like), conductive materials (e.g., polyacetylene and poly(para phenylene vinylene) (PPV)), combinations thereof, and the like), semiconductor materials (e.g., Silicon (Si), Germanium (Ge), Gallium Arsenide (GaAs) combinations thereof, and the like), doped semiconductor materials, dielectric materials (e.g., glasses, ceramics (e.g., borosilicate, and alumina or aluminosilicates) various metal oxides (e.g., tantalum oxide, aluminum oxide), silicon oxide, combinations thereof, and the like), conductive polymers (e.g., polyesters/Mylar, Kapton, polycarbonate, combinations thereof, and the like), and combinations thereof. In an embodiment, the membrane is coated with a conductive material, and the material under the coating may or may not be conductive (e.g., a dielectric material). In an embodiment, the conductive membrane is a metal wire mesh.

The size of the membrane orifices is chosen to support an appropriate pressure difference outside (e.g., in the sample environment) and inside of the ion generation chamber using capillary forces. In general, the diameter of the orifices is about 1 nm to 10 mm, about 10 nm to 100 μm, and about 100 nm to 10 μm.

The membrane can include about 1 to $10^{14}$ orifices per square centimeter, about 10 to $10^{10}$ orifices per square centimeter, and about 100 to $10^{6}$ orifices per square centimeter. The thickness of the membrane can about 1 nm to 10 mm, about 10 nm to 100 μm, and about 100 nm to 10 μm. The diameter of the membrane can about 1 nm to 10 mm, about 10 nm to 100 μm, and about 100 nm to 10 μm.

The ion collection system 12 can be used to collect, guide, and/or analyze the ions from the ion generation chamber 16. The ion collection system 12 can include, but is not limited to, a mass spectrometry system, an ion trapping system, an electrochemical (e.g., impedance or redox based) sensor, an electromechanical (e.g., piezoelectric) sensor, other systems that can be used to analyze ions, and combinations thereof.

The mass spectrometry system and the ion trapping system can include, but are not limited to, a time-of-flight (TOF) mass spectrometry system, an ion trap mass spectrometry system (IT-MS), a quadrapole (Q) mass spectrometry system, a magnetic sector mass spectrometry system, an ion cyclotron resonance (ICR) mass spectrometry system, and combinations thereof. The mass spectrometry system and the ion trapping system can include an ion detector for recording the number of ions that are subjected to an arrival time or position in a mass spectrometry system, as is known by one skilled in the art. Ion detectors can include, for example, a microchannel plate multiplier detector, an electron multiplier detector, or a combination thereof. In addition, the mass spectrometry system includes vacuum system components and electric system components, as are known by one skilled in the art.

FIG. 2 illustrates an embodiment of an ionization system. The ionization system includes, but is not limited to, the ion collection system 12, the ion source system 14, and the sample 22. The sample 22 includes, but is not limited to, a sample composition 34 disposed in a sample solution.

The scanning ion source system 14 includes, but is not limited to, a membrane 62 having orifices 64 and ion chamber walls 68. The membrane 62 is interfaced with the chamber walls 68. Appropriate electric and/or mechanical structures can be used to configure the membrane 62 and the chamber walls 68 to form the ion source system 14. The membrane 62 and the chamber walls 68 are electrically isolated.

A membrane voltage source 66 (V1) is in electrical communication with the membrane 62 and can apply a positive or negative DC potential to the membrane 62. In addition, the voltage source 66 can apply an AC potential to the membrane electrode 62. The voltage (V1) can range from about 0 V to 100 kV, but depends on the sample composition and solution, the electric potential applied to the other electrodes, and the like. The application of the voltage to the membrane 62 is performed to produce ions in the sample 22 adjacent the membrane 62 via redox reactions, for example. In addition, the application of the voltage to the membrane 62 forms the reverse-Taylor cone 42 of the sample solution through the membrane orifices 64, which draws in the ions from the sample composition to form solvated ions 44.

An ion chamber electrode or an array of individually-controlled ion-guiding electrodes 72 is disposed on portions of the chamber walls 68. The ion chamber electrode 72 is in electrical communication with the ion chamber voltage source 74 (V2) and can apply a positive or negative DC potential to the ion chamber electrode array 72. Each electrode in the array can have a different potential. In an embodiment, the ion chamber voltage source 74 can apply a DC and an AC voltage. The voltage can range from about 0 V to 100 kV, but depends on the sample composition, sample solution, the electric potential applied to the other electrodes, and the like. The application of the voltage to the ion chamber electrode 72 is performed to guide the ions (solvated ions 44 and de-solvated "dry" ions 46) from the membrane 62 at the first end of the ion source system 14 to the second end of the ion source system 14 adjacent the ion collection system 12. As mentioned above, the potential(s) applied to the ion chamber electrode(s) 72 depends in part on the potential applied to the membrane 62 and any electrodes present in the ion collection system 12 (e.g., ion collection electrode 84). One or more voltages can form one or more electric potential (force) gradients to influence the ions in a particular direction.

It should be noted that a heating source or element may be used to increase the temperature in the ion generation chamber 16 (e.g., being disposed adjacent the ion generation chamber) to assist in the de-solvation of the solvated "wet" ions 44 to de-solvated or "dry" ions 46. In short, the reverse-Taylor cone 42 of the electrolyte present in the ion generation chamber 16 forms solvated ions 44 in drops of the sample solution. The "wet" ions 44 progress to "dry" ions 46 through de-solvation processes that are known in electrospray technologies. The temperature, pressure, and applied electric potentials can be used to form "dry" ions 46.

The ion collection system 12 is disposed at the second end of the ion generation chamber 16 opposite the membrane 62. In another embodiment, the membrane 62 and the ion collection system 12 may not be "in-line" as shown in FIG. 2. The ion collection system 12 can include, but is not limited to, an interfacing structure 82 and an ion collection electrode 84. The interfacing structure 82 can be part of a structure used to connect the ion source system 14 with the ion collection system 12.

The ion collection electrode (e.g., array of electrodes) 84 is in electrical communication with an ion collection voltage source 86 (V3) and can apply a positive or negative DC potential to the ion collection electrode 84. Each electrode in the array can have a different potential. In an embodiment, the ion collection electrode 84 can apply a DC and an AC voltage. The voltage can range from about 0V to 100 kV, but depends on the sample composition, sample solution, the electric potential applied to the other electrodes, the type of the ion collection system 12, and the like. The application of the voltage to the ion collection electrode 84 is performed to guide the "dry" ions 46 into the ion collection system 12. As mentioned above, the potential applied to the ion collection electrode 84 depends in part on the potential applied to the membrane 62, the ion generation electrode (array of electrodes) 72, and any electrodes present in the ion collection system 12 or the ion source system 14.

As mentioned above, the ion collection system 12 can be used to collect, guide, and/or analyze the ions from the ion generation chamber 16. The ion collection system 12 can include, but is not limited to, a mass spectrometry system, ion trapping system, electrochemical sensors, electromechanical sensors, other systems that can be used to analyze ions, and combinations thereof.

One or more voltages can form one or more electric field (force) gradients to influence the ions in a particular direction. For example, the voltage potentials applied to one or more of the membrane 62, the ion chamber electrode 72, and/or the ion collection electrodes 84 can form one or more electric field (force) gradients that may drive the ions in a particular direction(s).

The pressure outside the ion generation chamber (P1), the pressure in the ion generation chamber (P2), and the pressure in the ion collection system 12 (P3) can vary depending, in part, on the ion collection system 12, the dimensions of the ion generation system 14, the size and shape of the membrane orifices, the sample solution, the degree of solvation of the ions entering the ion generation system 14, the mode of the system operation, and the like. P1, P2, and P3 can be about $10^{-10}$ torr (high vacuum) to 100 times the atmospheric pressure (100*760 torr). In an embodiment, the relative pressures may be the following: P1≧P2≧P3, and it can be controlled by using the external vacuum and/or compression pumps, proper vacuum isolation fixtures, and in some embodiments, when the ion generation chamber is submerged into the electrolyte solution, the size of the membrane orifices may be used to control the pressure difference P1 and P2 using the capillary forces at the liquid/membrane interface. Other combinations in relative magnitude of pressures P1, P2, and P3 can also be envisioned.

Figure 3:
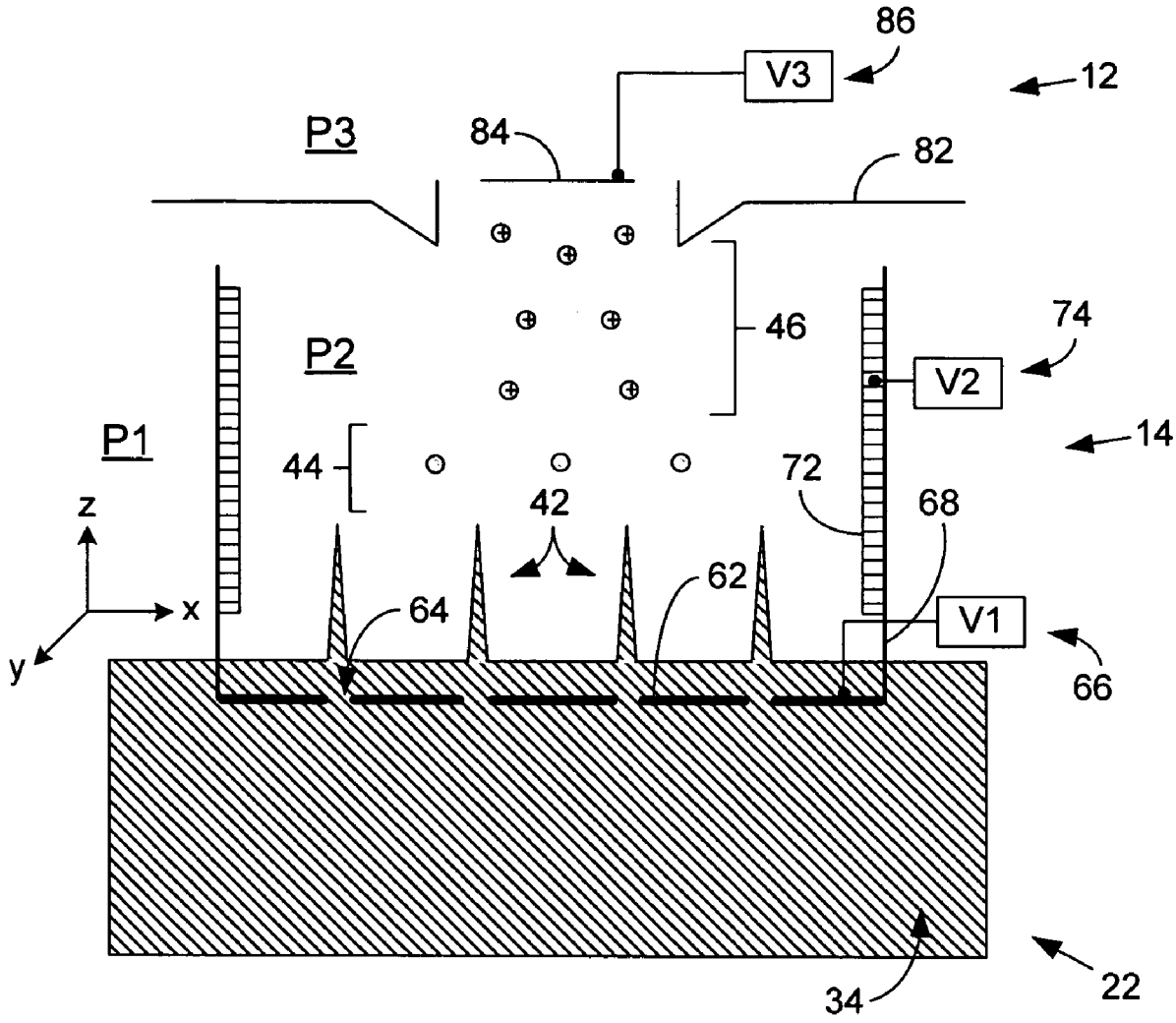
FIG. 3 illustrates an embodiment of another ionization system of the present disclosure.

FIG. 3 illustrates another embodiment of the ionization system. In FIG. 3, the sample solution level is raised so that solution 34 enters the ion generation chamber 14 through the orifices 64 of the membrane 62. It should be noted that the reverse-Taylor cone 42 is still generated under these conditions and ions can be generated in the sample 22.

Figure 4:
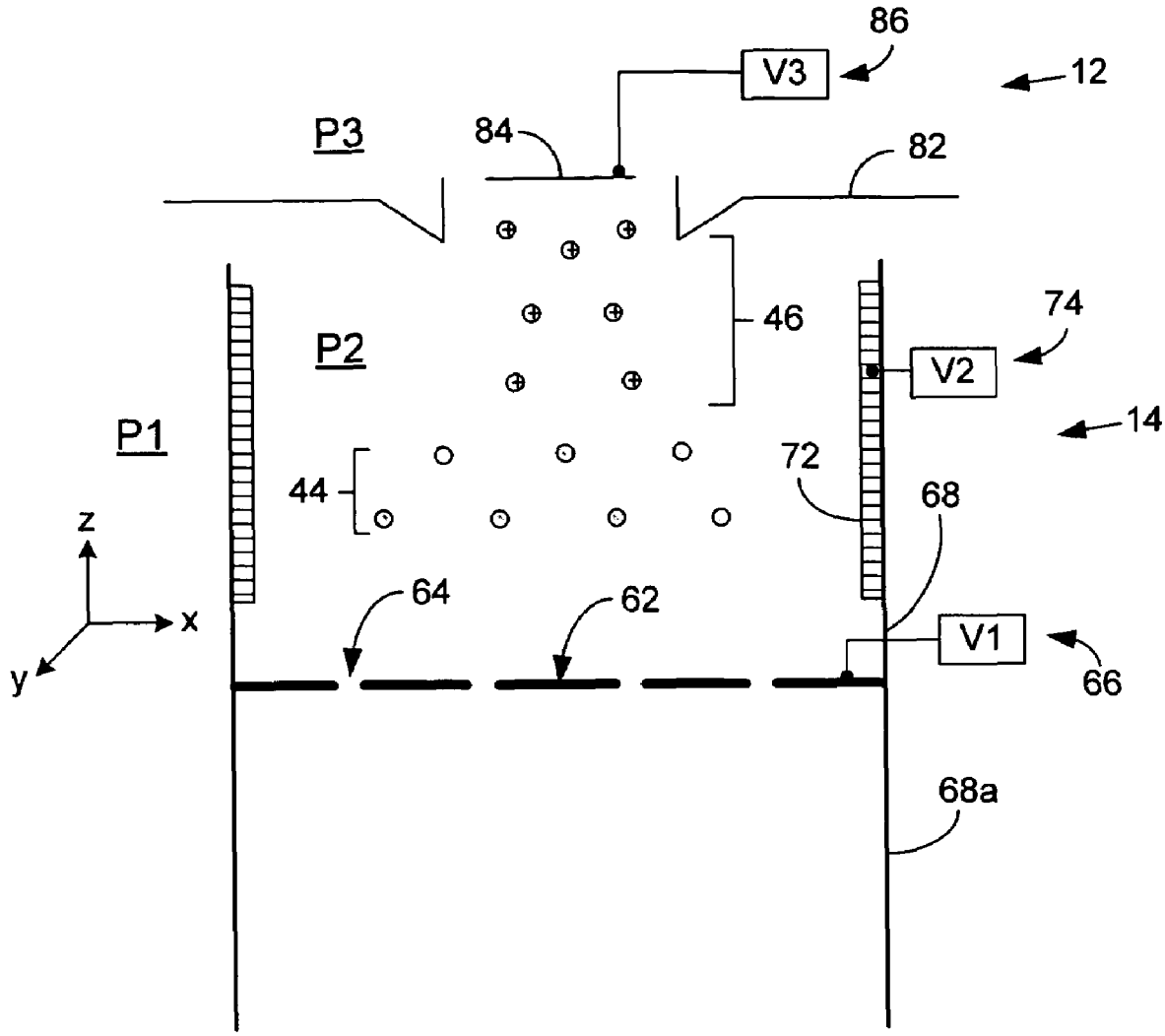
FIG. 4 illustrates an embodiment of another ionization system of the present disclosure.

FIG. 4 illustrates another embodiment of the ionization system. In FIG. 4, the chamber walls of the ion generation chamber 68 are extended longer (extended chamber walls 681) than in the embodiments illustrated in FIGS. 2 and 3. In this embodiment, the extended chamber walls 68*a* (or a structure used to extend the chamber walls that is attached to the chamber walls) may be used to interact with a sample (e.g., a biological sample). In an embodiment, a patch-clamp method can be used to study a biological cell or other structure such as, but not limited to, a bacteria and a virus.

Figure 5A:
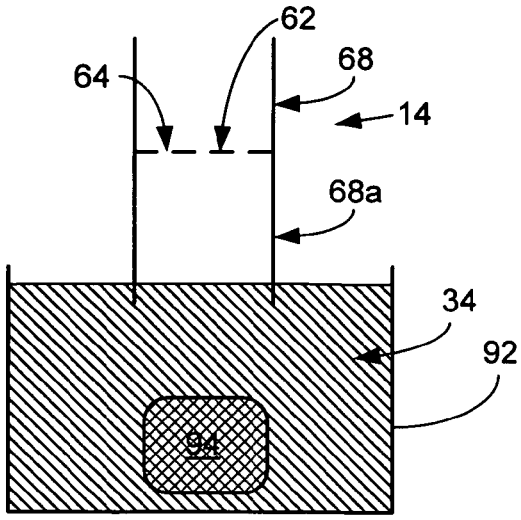
FIGS. 5A through 5C illustrate an embodiment of using the ionization system in which the sample includes a biological cell.
Figure 5B:
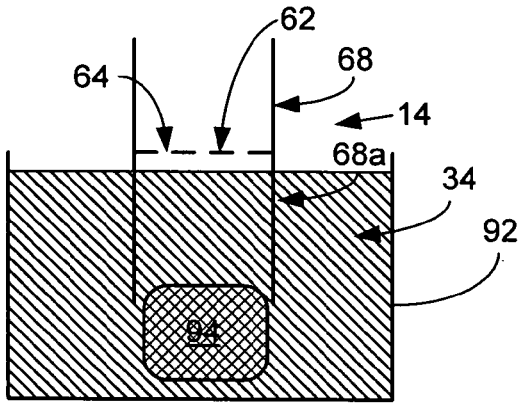
Figure 5C:
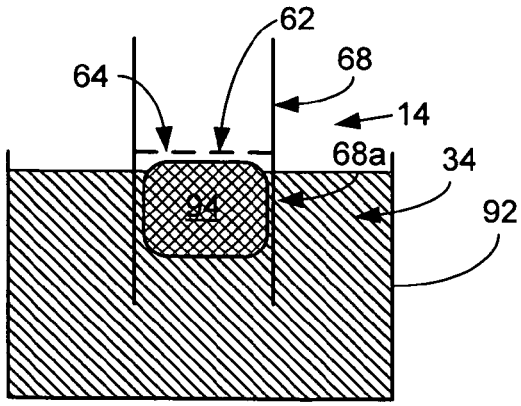

For example, FIGS. 5A through 5C illustrate an embodiment of an ion source system 14 having extended chamber walls 68*a*. FIG. 5A illustrates the ion source system and a sample structure 92 including a biological cell 94. FIG. 5B illustrates the ion source system being introduced to the sample. FIG. 5C illustrates the biological cell 94 being drawn into the channel of the extended chamber walls 68*a* and adjacent the membrane 62. The biological cell 94 can be drawn into the channel of the extended chamber walls 68*a* (e.g., via a vacuum). Once the biological cell 94 is adjacent the membrane, the vacuum may or may not be released. An electric potential can be applied to the membrane 62 to generate ions of molecules (e.g., biomolecules such as polypeptides and/or polynucleotides) on the surface (i.e., in or on the membrane) of the biological cell 94 and/or within the biological cell 94. Then, an electrohydrodynamically-induced reverse-Taylor cone of the sample solution including the ionized biomolecules is formed and extends through one or more of the plurality of the membrane orifices 64 into the ion generation chamber 16.

Figure 6A:
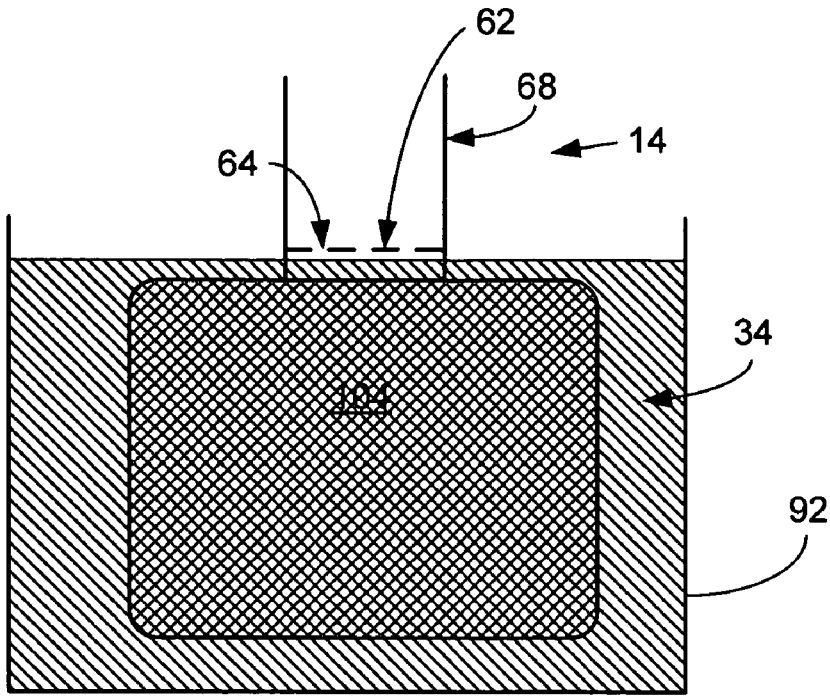
FIGS. 6A and 6B illustrate another embodiment of using the ionization system in which the sample includes a biological cell.
Figure 6B:
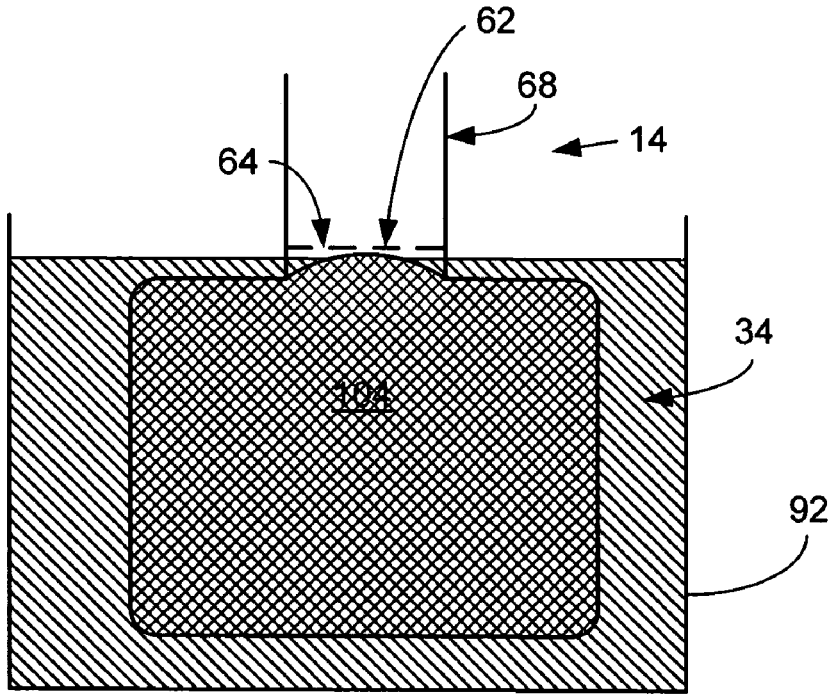

In another example, FIGS. 6A and 6B illustrate an embodiment of an ion source system having dimensions so that only a portion of a biological cell 104 can be drawn adjacent the membrane 62. FIG. 6A illustrates the ion source system 14 and a sample structure 92 including a biological cell 104. FIG. 6B illustrates a portion of the biological cell 104 being drawn adjacent the membrane 62. The biological cell 104 can be drawn adjacent the membrane via a vacuum. Once the biological cell 104 is adjacent the membrane, the vacuum may or may not be released. An electric potential can be applied to the membrane 62 to generate ions of molecules (e.g., biomolecules such as polypeptides and/or polynucleotides) on the surface (i.e., in or on the membrane) of the biological cell 104 and/or within the biological cell 104. Then, an electrohydrodynamically-induced reverse-Taylor cone of the sample solution including the ionized biomolecules is formed and extends through one or more of the plurality of the membrane orifices 64 into the ion generation chamber 16.

It should be noted that in reference to both embodiments shown in FIGS. 5A through 5C and 6A and 6B, as well as other embodiments, judicious application of the electric potential V1 could be used to selectively pull the charged biomolecules either from the biological cell membrane or from the inside of the biological cell. By changing the magnitude of the electric field, cell poration (opening pores in the cell membrane) or lysis (destruction of the cell membrane) can be induced to release the cell content for ionic analysis by the probe with (lysis) or without (poration) cell death.

While embodiments of the present disclosure are described in connection with Example 1 and the corresponding text and figures, there is no intent to limit embodiments to the embodiments in these descriptions. On the contrary, the intent is to cover all alternatives, modifications, and equivalents included within the spirit and scope of embodiments of the present disclosure.

EXAMPLE 1

The following experiments demonstrate that embodiments of the present disclosure are capable of reversibly generating charged ions in a sample, transporting the ions through the membrane, transporting the ions in the ion generating chamber, measuring a signal, and testing different solutions/samples having varying ion concentration (ionic strength) and chemical composition.

An embodiment of the present disclosure includes a cylindrical quartz sampling tube with the metal mesh acting as the membrane 62 and the working electrode (with a plurality of 25 micrometer diameter orifices 64) and the counter (ground) electrode 84 positioned inside of the sampling tube at a controlled distance (via XYZ micrometer stage). The counter electrode 84 was also connected to a currentmeter with a pre-amplifier, which was used to measure the electric current produced during experiments. In this embodiment, the counter electrode 84 also functioned as an ion collection system 12. Detection of the measurable current on the counter electrode and its dependence on the sampling solution ion composition and probe configuration (e.g., distance between the working and the ground electrodes) is direct evidence of the device capabilities as an ion probe system.

The experiments were repeated several times starting from the "all equipment OFF" position. The following is a summary of results. The solutions of deionized water, various salts, and MeOH—$H_2O$-Acetic Acid (varying concentration from 0.1 to 1.0%) were used as the ionic buffers in the experiments.

Effect of the applied potential on the working electrode on ion generation: When the zero potential (relative to the ground) was applied to the electrode no measurable current (within the detection system noise) was produced regardless of the ionic strength of electrolyte (e.g., from pure dielectric DI water to highly concentrated salt solution). An increase in the voltage (gradually from 0 V to 500 V to 1000 V to 1250 V) applied to the working electrode resulted in a significant (three or more orders of magnitude increase) in the detected current (which is a measure of ion generation and transport from the working electrode to the reference electrode) for the electrolyte solutions. The effect was more significant with an increase in the solution ionic strength (e.g., when acid concentration was increased), when the working mesh electrode was not fully submerged, but in direct contact with the solution, and when the distance between the working mesh electrode and the reference electrode was the smallest (varied from about 3 cm down to about 1 mm). This provides experimental proof of successful ion generation using reverse-Taylor-cones formed above each hole in the mesh of the working electrode 62 upon application of sufficiently strong electric potential relative to the ground counter (collection) electrode 84.

Effect of the solution composition/ionic strength on ion generation: The device was capable of sensitive detection of a change in the electric current flowing through the ground electrode (device detector) when testing of the electrolyte solutions/samples with different ionic strength of electrolyte (accomplished by varying acid concentration in the MeOH—$H_2O$-Acetic Acid electrolyte). The experiments were performed at a constant distance mode to eliminate the effect of the between-the-electrode distance on the detected electric current. The experiments clearly showed an increase in detected ions (current) while electrospraying the higher ionic strength sample, and the operation was reversible (e.g., no hysteresis was observed) when testing was first performed of the high ionic strength samples and then the low ionic strength samples and vice-versa. The same results were observed when samples of different ionic composition (e.g., different salts) were analyzed (imaged) by the device. This demonstrates the capability for electrospraying samples of different ionic make-up by embodiments of the present disclosure.

Although the methodologies of this disclosure have been particularly described in the foregoing disclosure, it is to be understood that such descriptions have been provided for purposes of illustration only, and that other variations both in form and in detail can be made thereupon by those skilled in the art without departing from the spirit and scope of the present invention, which is defined solely by the appended claims.

What is claimed is:

1. A method, comprising:

providing a scanning ion source system, comprising:

an ion generation chamber including a conductive membrane disposed at a first end of the ion generation chamber and chamber walls interfaced with the conductive membrane, wherein the conductive membrane includes a plurality of orifices through the conductive membrane, wherein the orifices have a diameter of about 1 nanometer to 10 millimeters, and wherein a voltage source is in electrical communication with the conductive membrane;

disposing the membrane into a sample;

applying a first voltage to the membrane;

ionizing molecules in the sample adjacent the membrane to produce a plurality of first ionized molecules; and producing a reverse-Taylor-cone of the sample through one or more of the orifices in the membrane, wherein the reverse-Taylor-cone extends into the ion generation chamber, and wherein the reverse-Taylor-cone of the sample includes the first ionized molecules.

2. The method of claim 1, further comprising:

applying a second voltage to an ion generation chamber electrode disposed on a portion of the chamber walls, wherein the first voltage and the second voltage generate a first electric force that drives the first ionized molecules towards a second end of the ion generation chamber.

3. The method of claim 1, further comprising:

providing an ion collection system at the second end of the ion generation chamber; and applying a third voltage to an ion collection electrode, wherein the second voltage and the third voltage generate a second electric force that drives the first ionized molecules towards the ion collection chamber.

4. The method of claim 3, further comprising:

analyzing a mass-to-charge ratio of the first ionized molecules.

5. The method of claim 4, wherein disposing the membrane into a sample further comprises:

applying a vacuum to the ion generation chamber, wherein the sample includes at least one biological cell; and drawing a first biological cell adjacent the conductive membrane.

6. The method of claim 5, wherein ionizing molecules in the sample adjacent the membrane to produce a plurality of first ionized molecules further comprises:

ionizing molecules of the biological cell to form the plurality of first ionized molecules, wherein the molecules are selected from polypeptides, polynucleotides, or combinations thereof.

7. A method, comprising:

disposing an ion generation chamber into a sample, wherein the ion generation chamber includes a conductive membrane having a plurality of orifices;

applying a first voltage to the conductive membrane;

ionizing molecules in the sample adjacent the conductive membrane to produce a plurality of solvated first ionized molecules;

producing a reverse-Taylor-cone of the sample through one or more of the orifices in the conductive membrane, wherein the reverse-Taylor-cone extends into the ion generation chamber, and wherein the reverse-Taylor-cone of the sample includes the solvated first ionized molecules;

dispersing solvated first ionized molecules from the reverse-Taylor-cone into the ion generation chamber;

generating an electromotive force within the ion generation chamber that drives the solvated first ionized molecules away from the membrane; and generating de-solvated first ionized molecules from the solvated first ionized molecules.

8. The method of claim 7, further comprising:

analyzing a mass-to-charge ratio of the de-solvated first ionized molecules.

9. The method of claim 7, further comprising:

heating the ion generation chamber to assist in de-solvation of the salvated first ionized molecules produced from the reverse-Taylor-cone of the electrolyte.

* * * * *

UNITED STATES PATENT AND TRADEMARK OFFICE

CERTIFICATE OF CORRECTION

PATENT NO. : 7,411,182 B2
APPLICATION NO. : 11/336136
DATED : August 12, 2008
INVENTOR(S) : Fedorov et al.

It is certified that error appears in the above-identified patent and that said Letters Patent is hereby corrected as shown below:

Column 4, line 31, delete “nanometer” and replace with

--nanometers--

Column 5, line 24, delete “can about” and replace with

--can be about--

Column 5, line 26, delete “can about” and replace with

--can be about--

Signed and Sealed this

Eighteenth Day of November, 2008

JON W. DUDAS
*Director of the United States Patent and Trademark Office*